US008191604B2

(12) United States Patent
Wang

(10) Patent No.: US 8,191,604 B2
(45) Date of Patent: Jun. 5, 2012

(54) FABRIC GATE

(76) Inventor: Tsung-Hsiang Wang, Taipei Hsien (TW)

( * ) Notice: Subject to any disclaimer, the term of this patent is extended or adjusted under 35 U.S.C. 154(b) by 136 days.

(21) Appl. No.: 12/780,096

(22) Filed: May 14, 2010

(65) Prior Publication Data

US 2010/0307700 A1 Dec. 9, 2010

(30) Foreign Application Priority Data

Jun. 6, 2009 (TW) ..... 98210002 U

(51) Int. Cl.
*E06B 9/56* (2006.01)

(52) U.S. Cl. ..... 160/296; 160/23.1; 160/24; 160/305; 160/293.1

(58) Field of Classification Search ..... 160/296, 160/305, 309, 313, 301, 315, 323.1, 293.1, 160/23.1, 24
See application file for complete search history.

(56) References Cited

U.S. PATENT DOCUMENTS 5,294,167 A * 3/1994 Yu ..... 242/372
5,690,317 A * 11/1997 Sandsborg ..... 256/1
5,773,947 A * 6/1998 Torii et al. ..... 318/466
5,934,354 A * 8/1999 Price et al. ..... 160/370.22
6,375,165 B1 * 4/2002 Sherratt et al. ..... 256/24
6,390,526 B1 * 5/2002 Ament et al. ..... 296/37.16
6,536,502 B2 * 3/2003 Britto et al. ..... 160/23.1
6,854,505 B2 * 2/2005 Grubb et al. ..... 160/296
6,991,019 B2 * 1/2006 Chang ..... 160/24
7,082,981 B2 * 8/2006 Perez, Jr. ..... 160/24
7,100,668 B2 * 9/2006 Allsop ..... 160/321
7,178,792 B2 * 2/2007 Monahan et al. ..... 256/73
7,219,709 B1 * 5/2007 Williams ..... 160/24
7,438,112 B2 * 10/2008 Cheng ..... 160/24
7,461,683 B2 * 12/2008 Wang ..... 160/296
7,832,037 B2 * 11/2010 Overton ..... 5/655
2007/0051478 A1 * 3/2007 Wieczorek et al. ..... 160/323.1

* cited by examiner

*Primary Examiner* — Katherine W Mitchell
*Assistant Examiner* — Johnnie A Shablack
(74) *Attorney, Agent, or Firm* — C. G. Mersereau; Nikolai & Mersereau, P.A.

(57) ABSTRACT

A fabric gate has a ratchet assembly, a delaying assembly and a driving device. The ratchet assembly has a ratchet, a positioning ring and a driven pad. The ratchet has a wheel provide with multiple upper ratchet teeth and multiple lower ratchet teeth. The upper ratchet teeth extend toward a direction opposite to that of the lower ratchet teeth extending. The positioning ring is expandable and has engaging teeth engaging respectively with the ratchet teeth on the ratchet. The driven pad is attached to the top of the positioning ring to expand the positioning ring when the driven pad is rotated by the driving device. The delaying assembly is mounted in the top cap and connected to the ratchet assembly to reduce to the rotating speed of the driven pad.

20 Claims, 21 Drawing Sheets

FABRIC GATE

BACKGROUND OF THE INVENTION

1. Field of the Invention

The present invention relates to a safety gate, and more particularly to a fabric gate for forming a safety zone for children or pets with an expandable fabric.

2. Description of Related Art

A safety gate is mounted in a room to form safety zone for children or pets to keep them from a dangerous location, such as kitchen. A conventional fabric gate comprises two securing columns and an expandable fabric. The securing columns are secured respectively on two walls and including a reeling column and a connecting column. The fabric is reeled in the reeling columns and is expended to connect to the connecting column and block the passage between the walls. A ratchet device is mounted in the reeling column to keep the fabric from being retracted and reeled into the reeling column unintentionally. To reel the fabric into the reeling column, the fabric has to be disconnected from the connecting column and pulled outward furthermore, and the fabric will be retracted and reeled into the reeling column automatically.

However, if someone wants to pass the gate, the fabric has to be reeled into the reeling column completely and be expanded again. Therefore, the use of the conventional fabric gate is inconvenient.

To overcome the shortcomings, the present invention tends to provide a fabric gate to mitigate or obviate the aforementioned problems.

SUMMARY OF THE INVENTION

The main objective of the invention is to provide a fabric gate being convenient in operation. The fabric gate has a reeling column, a ratchet assembly, a coil torsion spring, a delaying assembly, a driving device, an expandable fabric and a connecting column assembly. The reeling column assembly has a hollow post, a top cap, a bottom cap and a reeling shaft. The post has a central hole defined through the post and a fabric outlet defined longitudinally in the post and communicating with the central hole. The top cap and a bottom cap are attached respectively to two ends of the post, and the top cap has a slot defined laterally in the top cap. The reeling shaft is mounted rotatably in the central hole in the post and has a top end. The ratchet assembly is mounted in the top cap of the reeling column assembly and has a ratchet, a positioning ring and a driven pad. The ratchet is mounted rotatably in the top cap and has a central shaft and a wheel. The central shaft is mounted securely around the top end of the reeling shaft. The wheel is formed around the central shaft and has multiple upper ratchet teeth and multiple lower ratchet teeth. The upper ratchet teeth extend toward a direction opposite to that of the lower ratchet teeth extending. The positioning ring is mounted around the wheel of the ratchet and has a top, an inner surface, a notch, an upper engaging tooth, a lower engaging tooth and two stubs. The notch is defined in the positioning ring to make the positioning ring having an expandable capability and two ends. The upper engaging tooth and the lower engaging tooth are formed on the inner surface of and respectively at the ends of the positioning ring and engage respectively with the upper ratchet teeth and the lower ratchet teeth on the ratchet. The stubs are formed on and protrude from the top respectively near the ends of the positioning ring. The driven pad is attached to the top of the positioning ring, is mounted around the central shaft of the ratchet and has a top, a periphery and two curved extensions.

The curved extensions are formed separately on and protrude radially from the periphery of the driven pad. Each curved extension has an end abutting with one of the stubs on the positioning ring. The coil torsion spring is connected to the reeling shaft. The delaying assembly is mounted in the top cap and connected to the ratchet assembly. The driving device is mounted in the top cap, connected to the delaying assembly and has a rotating plate, a torsion spring and a pushing tab. The rotating plate is mounted rotatably in the top cap and connected to the delaying assembly. The torsion spring is mounted in the top cap and has two ends connected respectively to the top cap and the rotating plate to provide a recoil force to the rotating plate. The pushing tab is connected securely to the rotating plate and is mounted slidably through and extends out from the slot in the top cap. The expandable fabric is reeled around the reeling shaft and has an expanded end extending out from the fabric outlet in the post. The connecting column assembly is parallel with the reeling column assembly and holds the expanded end of the expandable fabric in position.

Other objects, advantages and novel features of the invention will become more apparent from the following detailed description when taken in conjunction with the accompanying drawings.

DETAILED DESCRIPTION OF PREFERRED EMBODIMENT

Figure 1:
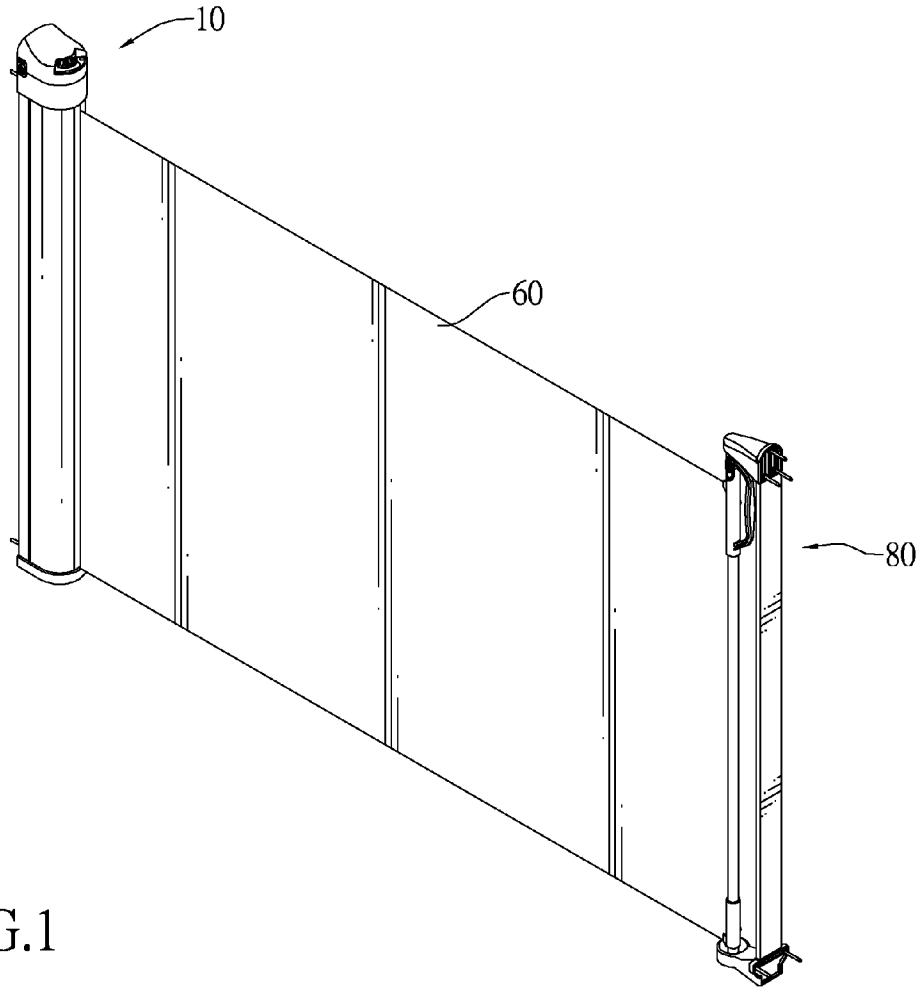
FIG. 1 is a perspective view of a fabric gate in accordance with the present invention in an expanded condition.
Figure 2:
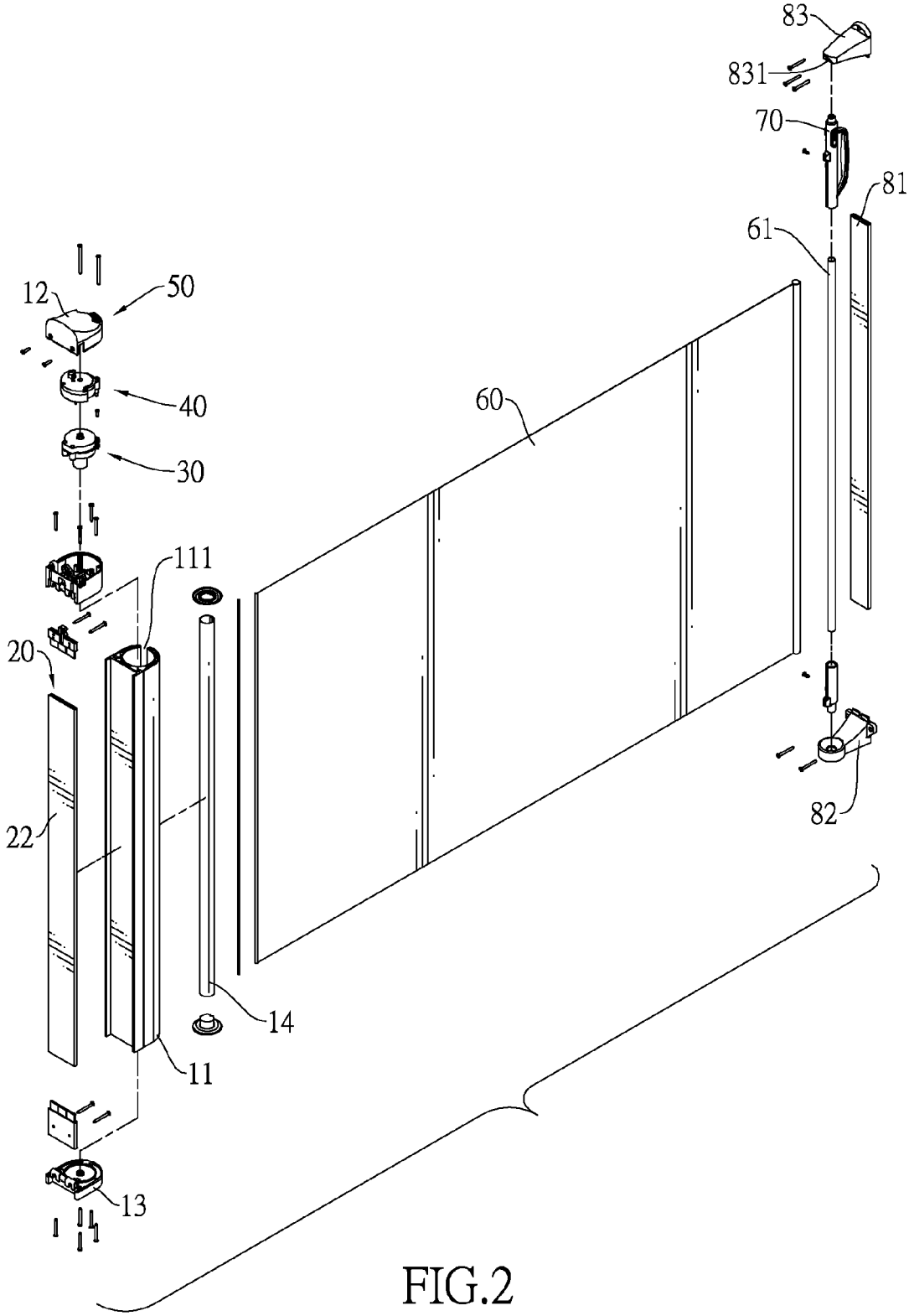
FIG. 2 is an exploded perspective view of the fabric gate in FIG. 1.
Figure 3:
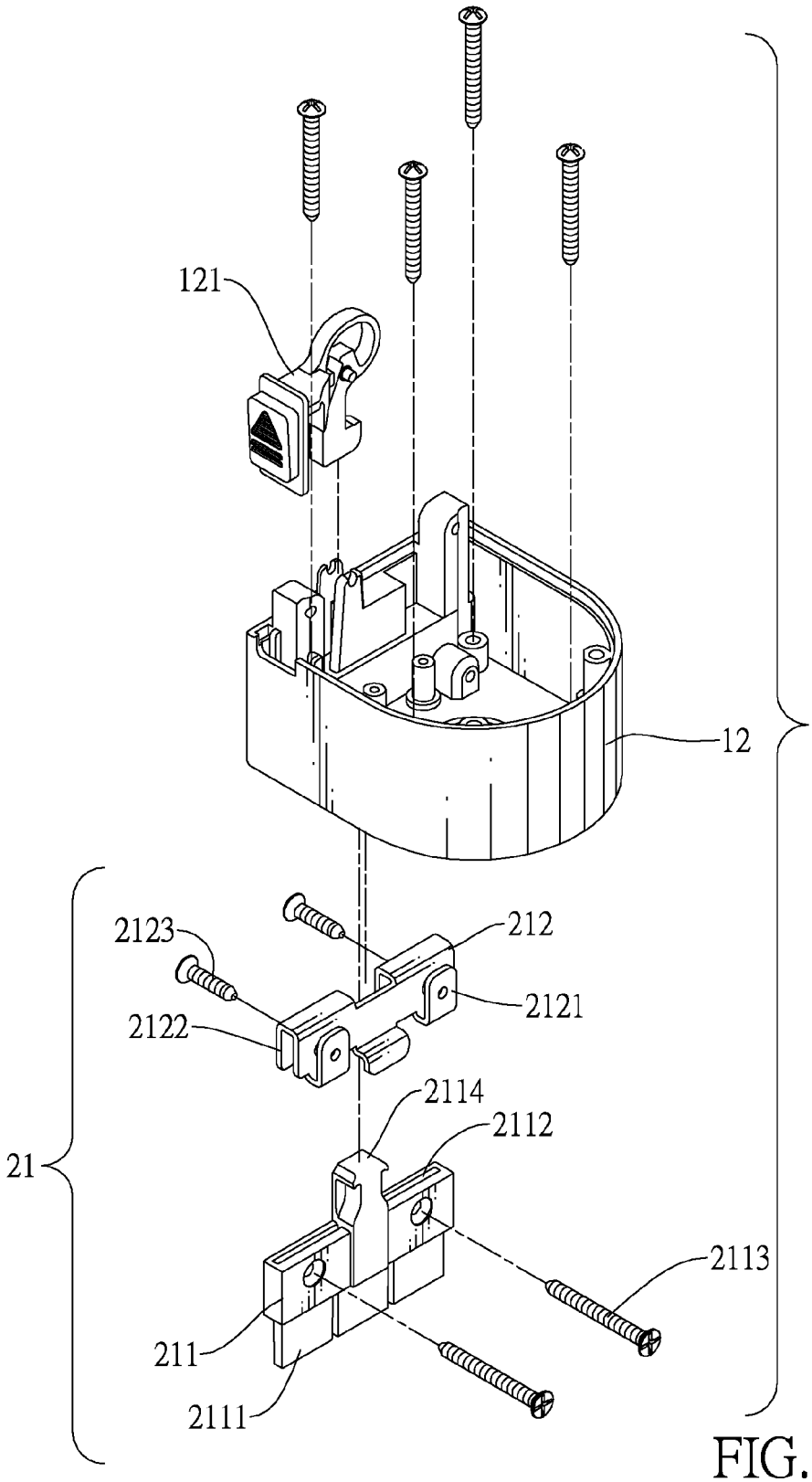
FIG. 3 is an enlarged exploded perspective view of the locking device and the top cap of the fabric gate in FIG. 1.
Figure 4:
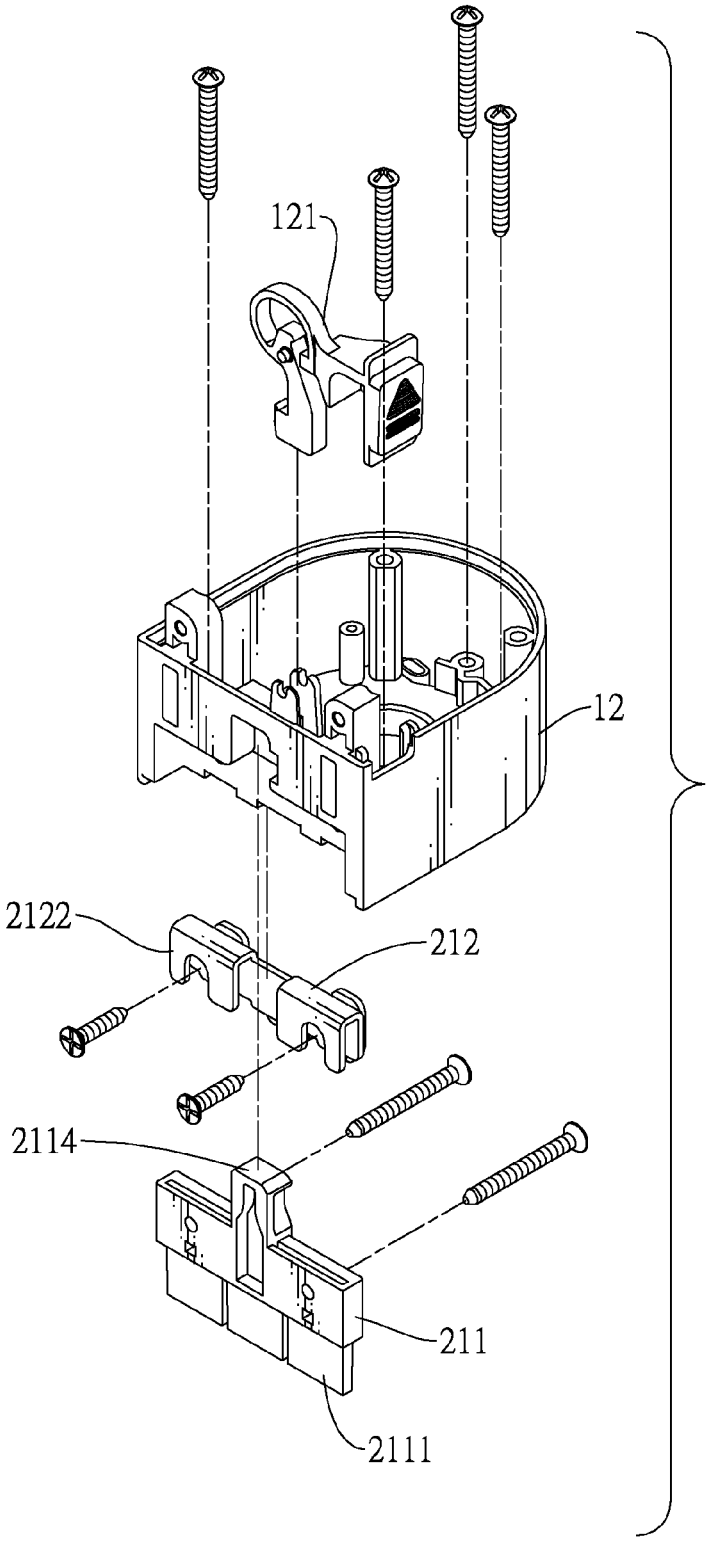
FIG. 4 is another enlarged exploded perspective view of the locking device and the top cap of the fabric gate in FIG. 1.
Figure 5:
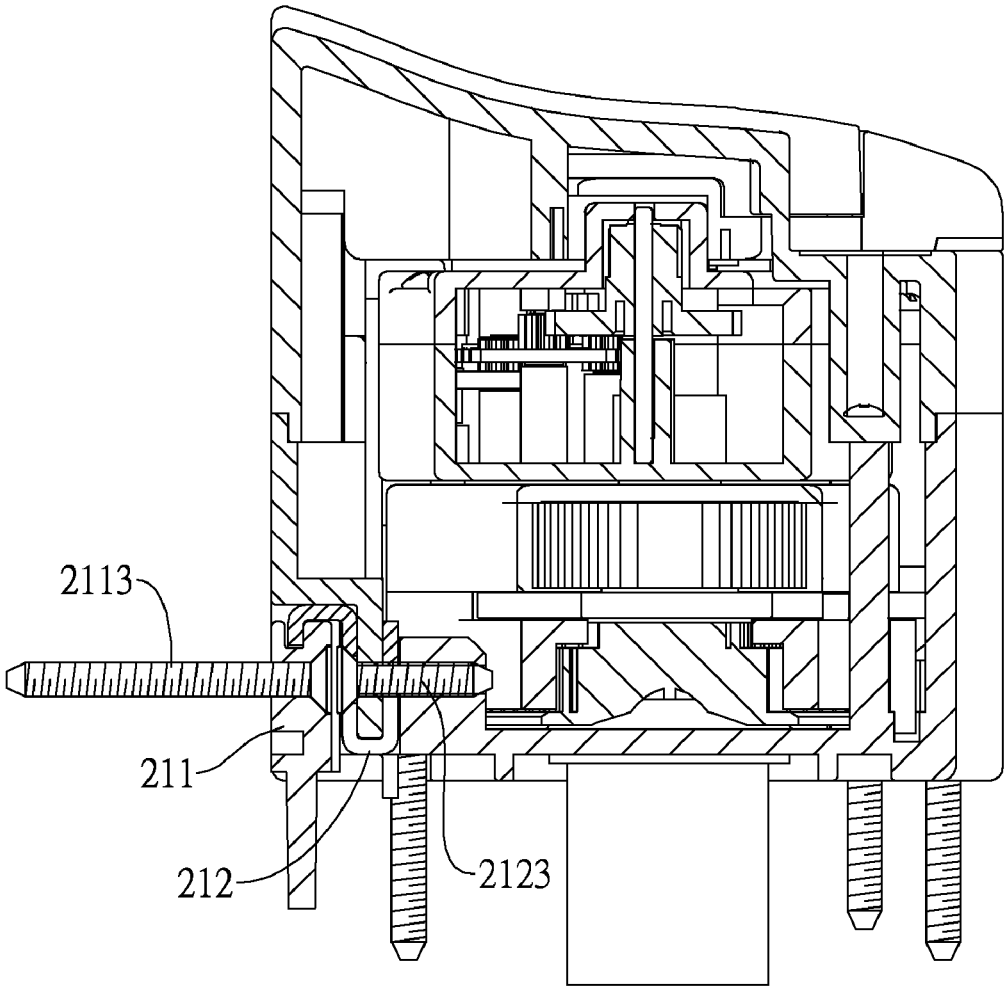
FIG. 5 is a side view in partial section of the top cap of the fabric gate in FIG. 1.
Figure 6:
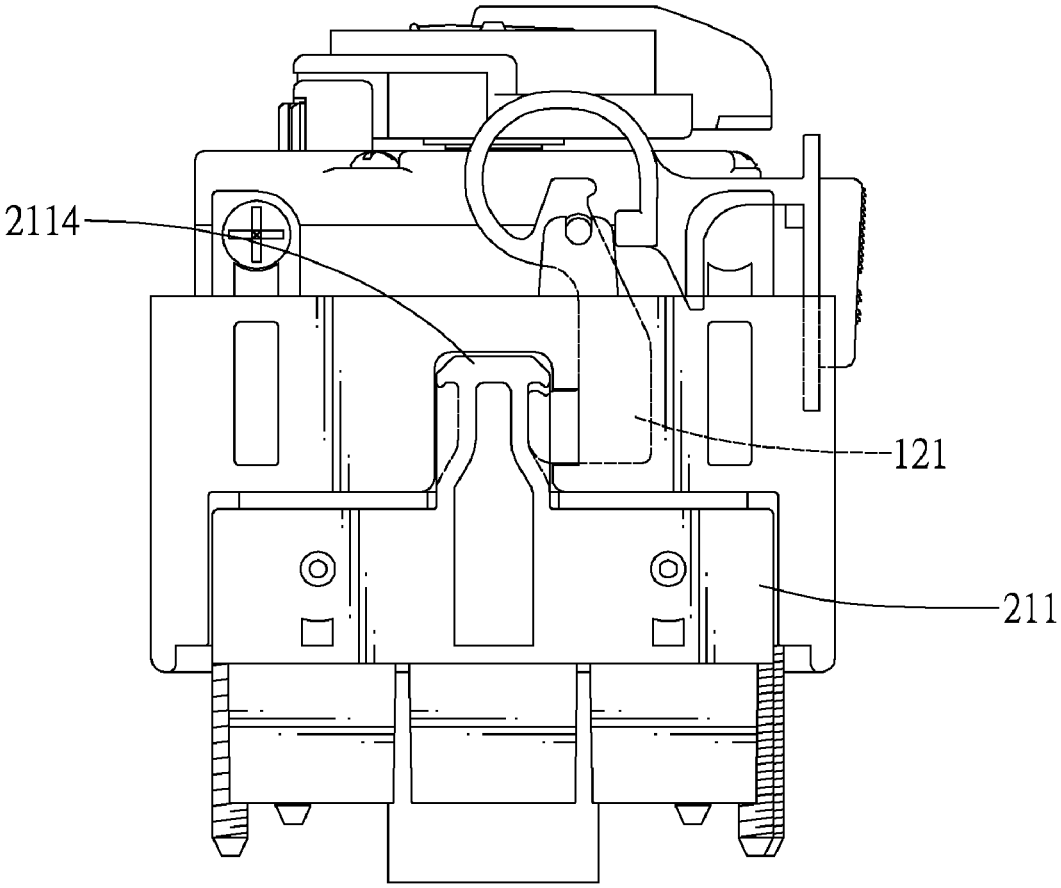
FIG. 6 is a side view of the top cap of the fabric gate in FIG. 1.
Figure 7:
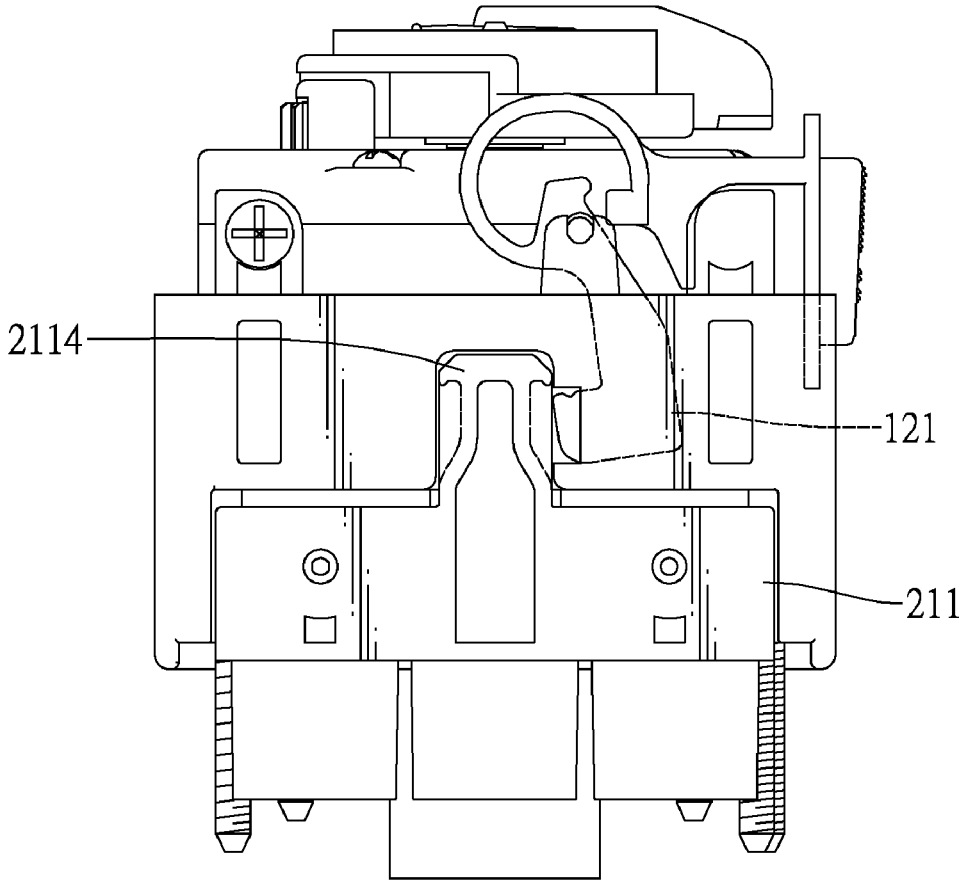
FIG. 7 is an operational side view of the top cap of the fabric gate in FIG. 6.
Figure 8:
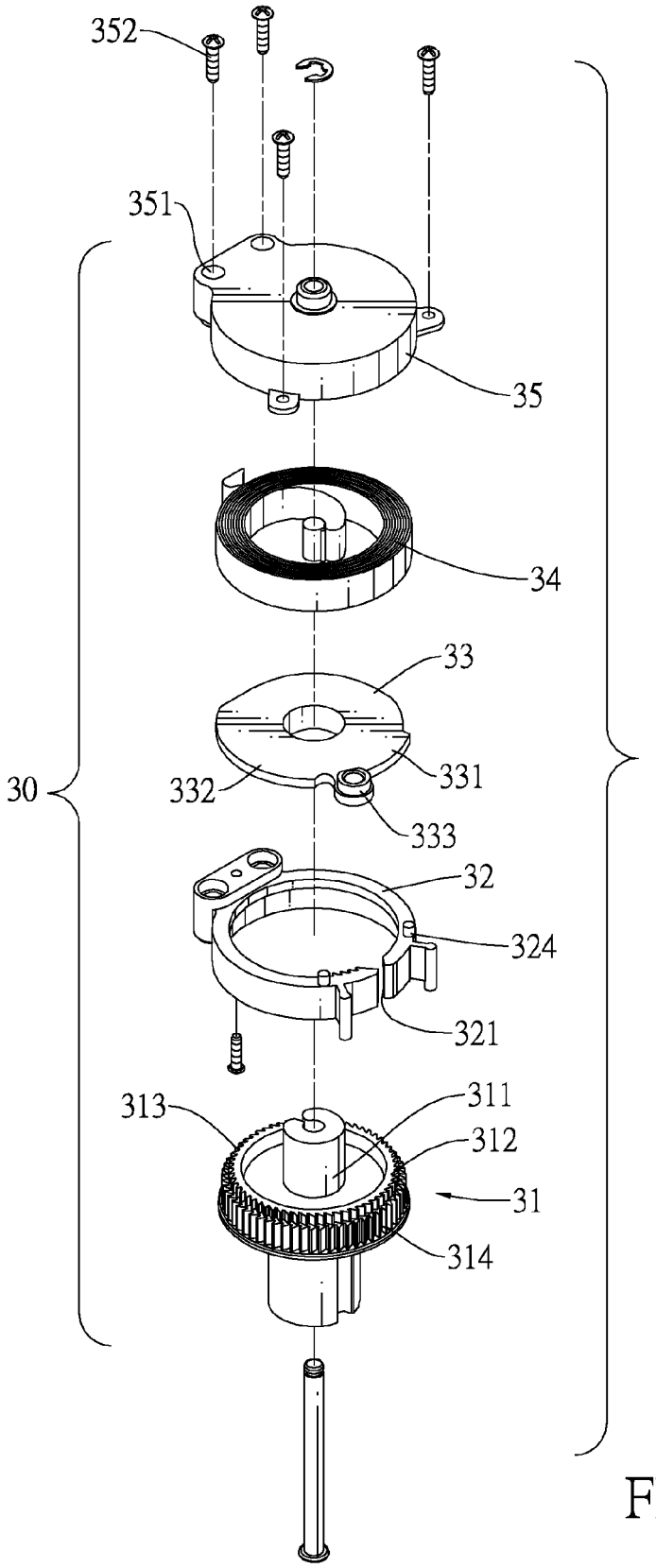
FIG. 8 is an exploded perspective view of the ratchet assembly of the fabric gate in FIG. 1.

With reference to FIGS. 1, 2 and 8, a fabric gate in accordance with the present invention comprises a reeling column assembly (10), a ratchet assembly (30), a coil torsion spring (34), a delaying assembly (40), a driving device (50), an expandable fabric (60) and a connecting column assembly (80).

The reeling column assembly (10) comprises a hollow post (11), a to cap (12), a bottom cap (13), a reeling shaft (14) and a locking assembly (20). The hollow post (11) has a central hole, two ends, a top opening, a bottom opening and a fabric outlet (111). The central hole is defined through the post (11). The top opening and the bottom opening are defined respectively in two ends of the post (11) and communicate with the central hole. The fabric outlet (111) is defined longitudinally in the post (11) and communicates with the central hole.

Figure 15:
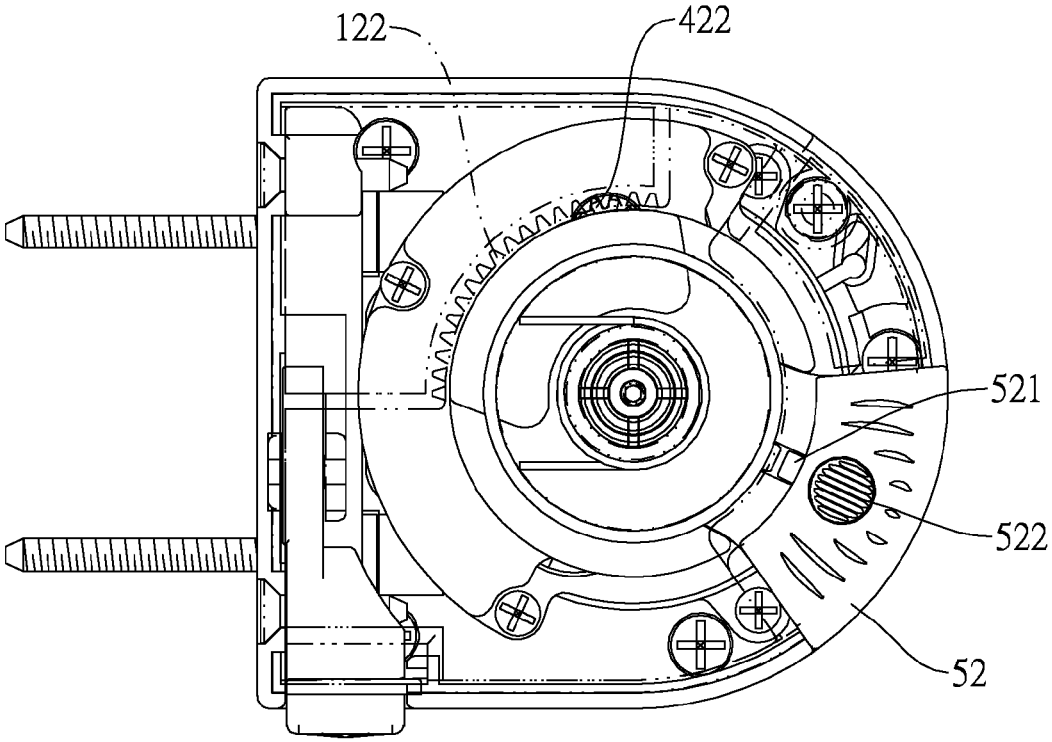
FIG. 15 is a top view of the driving device with the top cap of the fabric gate in FIG. 1.
Figure 16:
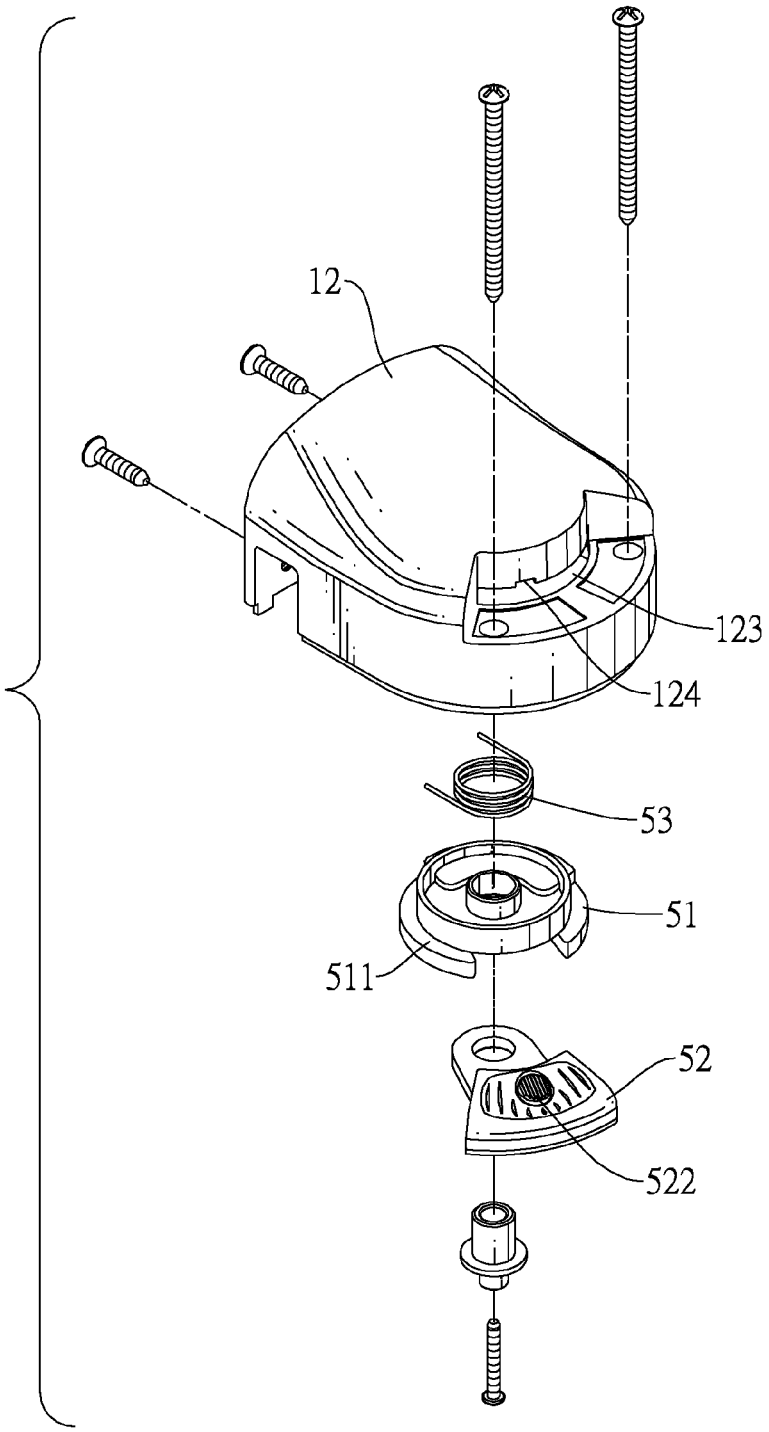
FIG. 16 is an exploded perspective view of the driving device of the fabric gate in FIG. 1.
Figure 17:
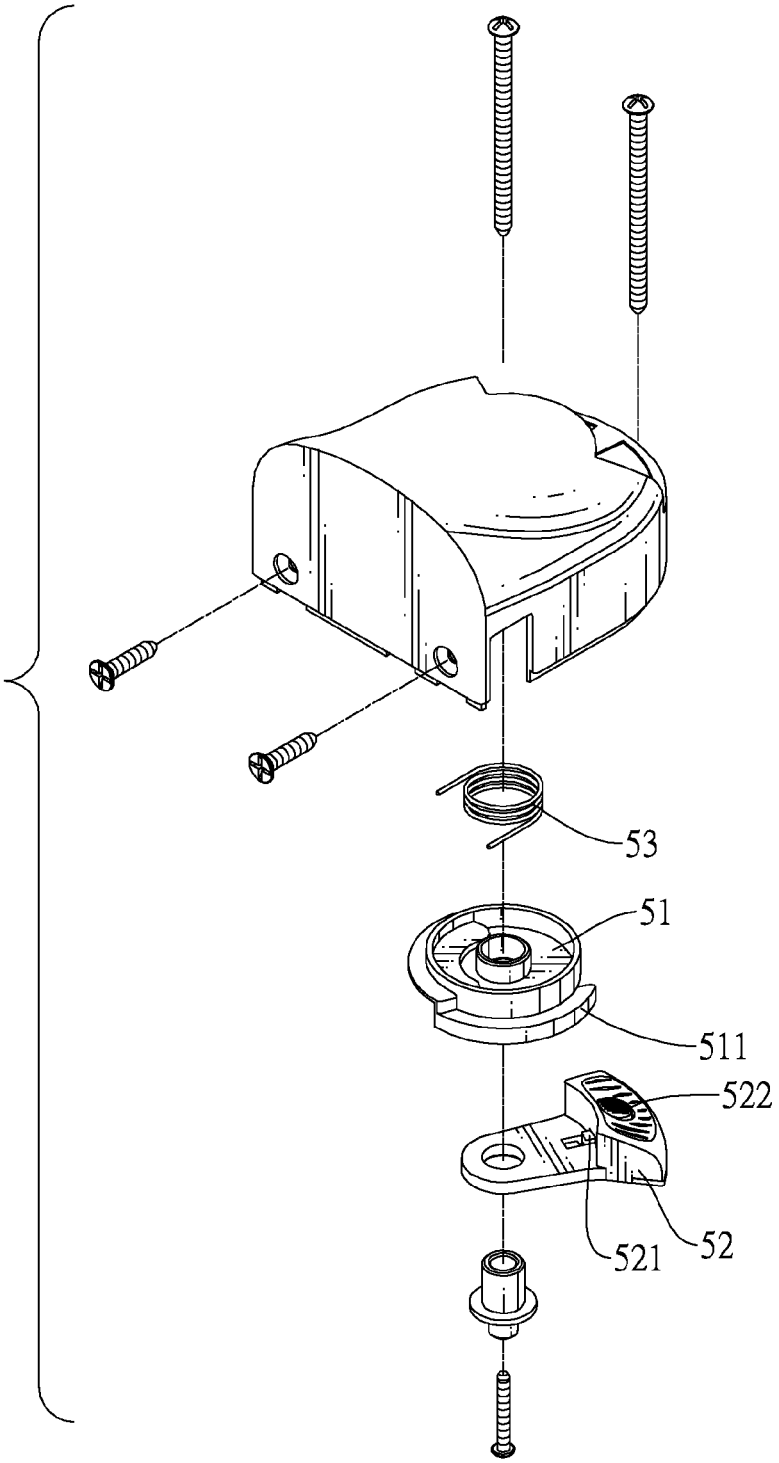
FIG. 17 is another exploded perspective view of the driving device of the fabric gate in FIG. 1.
Figure 18:
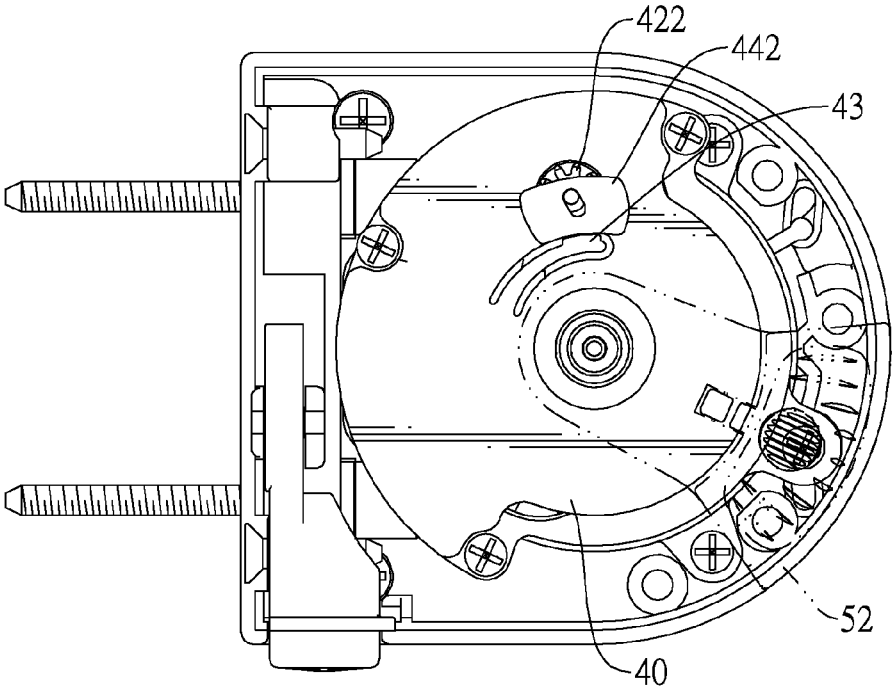
FIG. 18 is an operational top view of the driving device with the top cap of the fabric gate in FIG. 1.
Figure 19:
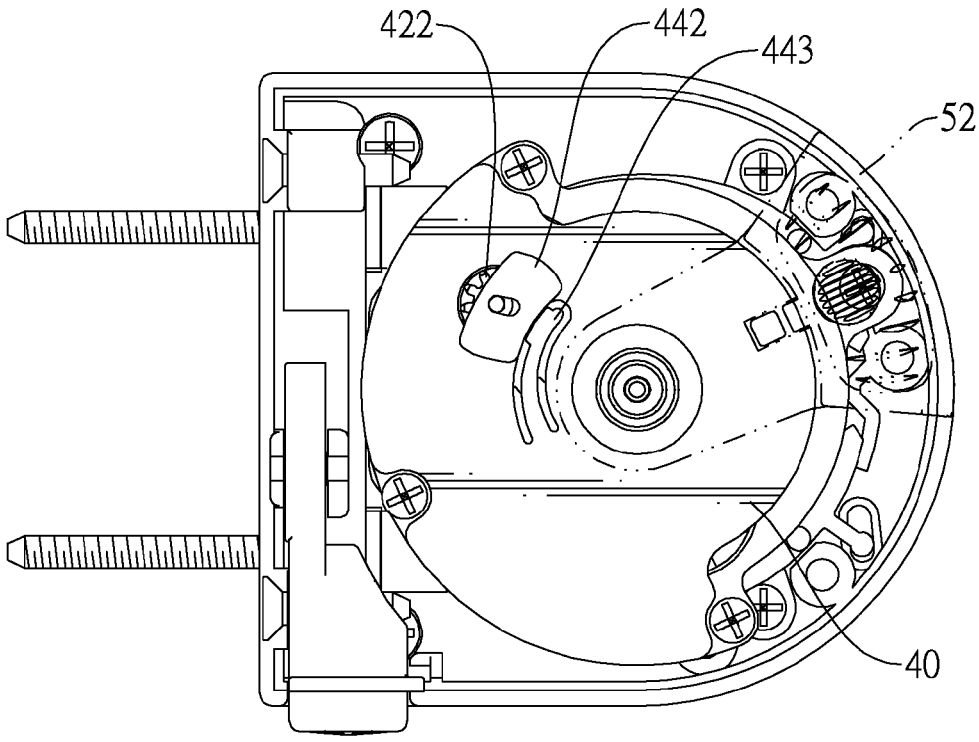
FIG. 19 is another operational top view of the driving device with the top cap of the fabric gate in FIG. 1.

The top cap (12) and the bottom cap (13) are attached respectively to the ends of the post (11) and close the top and bottom openings respectively. With further reference to FIG. 15, the top cap (12) has a curved rack (122) formed in the top cap (12). With further reference to FIG. 16, the top cap (12) may have a slot (123) defined laterally through the top cap (12) and having an engaging notch (124) defined in a top edge of the slot (123).

The reeling shaft (14) is rotatably mounted in the central hole of the post (11) and has a top end and a bottom end respectively extending rotatably through the top and bottom caps (12,13).

With further reference to FIGS. 2 to 5, the locking assembly (20) is attached to the post (11), is connected to the top cap (12) and the bottom cap (13) and comprises a securing board (22) and two locking devices (21). The securing board (22) is attached to one side of the post (11) and has two ends and multiple inserting holes defined respectively in the ends of the securing board (22). The locking devices (21) are connected respectively to the ends of the securing board (22), are connected respectively to the top and bottom caps (12,13), have similar structures to each other and each has a locking board (211) and a connecting bracket (212). The locking board (211) is securely connected to one end of the securing board (22) and has a board edge, a connecting edge, multiple inserts (2111), multiple inserting holes (2112), multiple securing holes and multiple fasteners (2113). The board edge is connected to the securing board (22), and the connecting edge is opposite to the board edge. The inserts (2111) are formed on and protrude from the board edge of the locking board (211) and are inserted respectively into the inserting holes in the corresponding end of the securing board (22) to connect the locking board (211) with the securing board (22). The inserting holes (2112) are defined in the connecting edge of the locking board (211). The securing holes are defined through the locking board (211). The fasteners (2113) may be nails or screws, are mounted respectively through the securing holes and are inserted into a wall to securely attach the locking board (211) to the wall.

The connecting bracket (212) is connected to the connecting edge of the locking board (211) and is connected securely to one of the top and bottom caps (12,13). The connecting bracket (212) has two edges, a cap side, a connecting side, multiple cap hooks (2121), multiple board hooks (2122), multiple securing holes and multiple fasteners (2123). The cap side faces to the corresponding cap (12,13), and the connecting side is opposite to the cap side. The cap hooks (2121) are formed on the cap side at one edge of the connecting bracket (212) and respectively engage holes defined in the corresponding cap (12,13). The board hooks (2122) are formed on the connecting side at the other edge of the connecting bracket (212) and are inserted respectively into the inserting holes (2112) in the locking board (211). The securing holes are defined through the connecting bracket (212), may be defined through the hooks (2121,2122) and are aligned respectively with the securing holes in the locking board (211). The fasteners (2123) may be nails or screws, are mounted through the securing holes in the connecting bracket (212), are inserted into a corresponding cap (12,13) and are aligned respectively with the fasteners (2113) on the locking board (211) in an axial direction. With the locking devices (21), the caps (12,13) can be securely connected to the securing board (22). With the axial alignments of the fasteners (2113,2123) on the locking board (211) and the connecting bracket (212), shearing stresses and torque applied to the fasteners (2113,2123) may be reduced.

In addition, with reference to FIGS. 3, 4, 6 and 7, the locking device (21) that is connected to the top cap (12) may further have a protrusion (2114) formed on and protruding from the connecting edge of the locking board (211). The top cap (12) may further have a locker (121) mounted in the top cap (12) and has a resilient hook engaging the protrusion (2114) on the locking board (211) of the corresponding locking device (21). With the engagement of the protrusion (2114) and the resilient hook, the locking board (211) is securely combined with the top cap (12). When the resilient hook is pressed to disengage from the protrusion (2114), the top cap (12) can be detached from the corresponding locking board (211).

Figure 9:
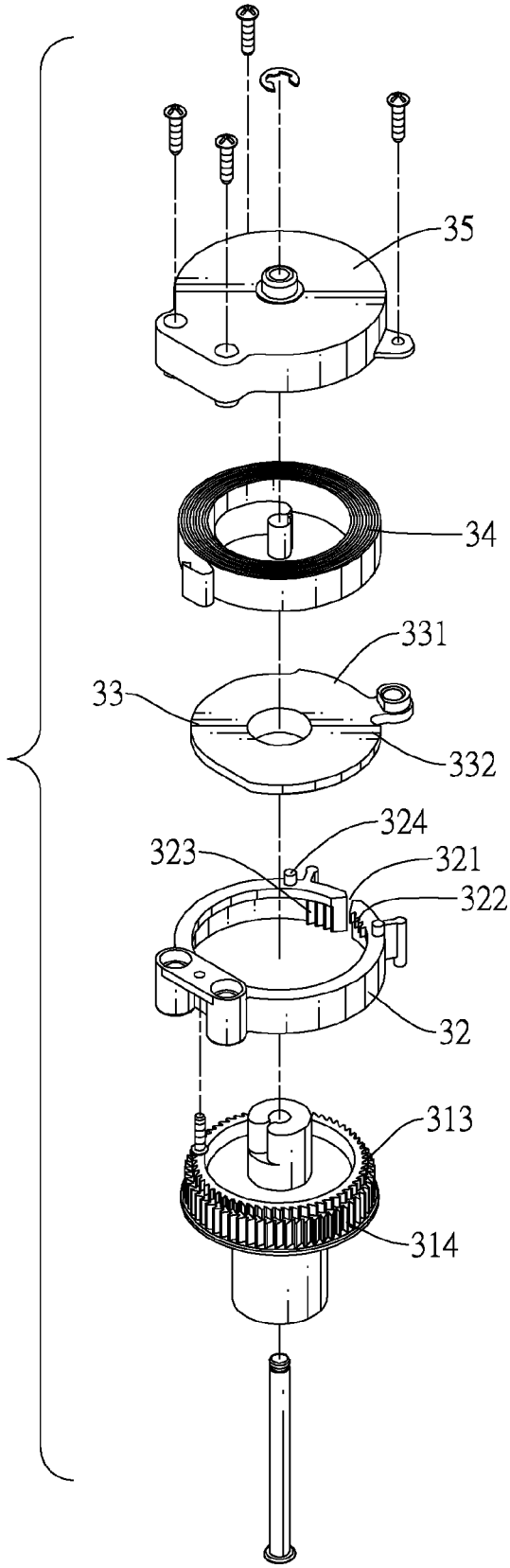
FIG. 9 is another exploded perspective view of the ratchet assembly of the fabric gate in FIG. 1.

With reference to FIGS. 2, 8 and 9, the ratchet assembly (30) is mounted in the top cap (12) of the reeling column assembly (10) and comprises a ratchet (31), a positioning ring (32), a driven pad (33) and a cover (35). The ratchet (31) is mounted rotatably in the top cap (12) and has a central shaft (311) and a wheel (312). The central shaft (311) is mounted securely around the top end of the reeling shaft (14). The wheel (312) is formed around the central shaft (311) and has multiple upper ratchet teeth (313) and multiple lower ratchet teeth (314). The upper ratchet teeth (313) has a diameter smaller than that of the lower ratchet teeth (314) and extend toward a direction opposite to that of the lower ratchet teeth (314) extending.

The positioning ring (32) is mounted in the top cap (12), is mounted around the wheel (312) of the ratchet (31) and has a top, an inner surface, a notch (321), an upper engaging tooth (322), a lower engaging tooth (323) and two stubs (324). The notch (321) is defined in the positioning ring (32) to make the positioning ring (32) being C-shaped and having an expandable capability and two ends. The upper engaging tooth (322) and the lower engaging tooth (323) are formed on the inner surface of and respectively at the ends of the positioning ring (30), and respectively engage the upper ratchet teeth (313) and the lower ratchet teeth (314) on the ratchet (31). The stubs (324) are formed on and protrude from the top respectively near the ends of the positioning ring (32).

The driven pad (33) is attached to the top of the positioning ring (32), is mounted around the central shaft (311) of the ratchet (31) and has a top, a periphery, two curved extensions (331,332) and a driven hub (333). The curved extensions (331,332) are formed separately on and protrude radially from the periphery of the driven pad (33). Each curved extension (331,332) has an end abutting with one of the stubs (324) on the positioning ring (32). The driven hub (333) is formed on and protrudes radially from the periphery of the driven pad (33) and between the curved extensions (331,332).

The cover (35) is mounted securely in the top cap (12) with fasteners and is attached securely to the top of the positioning ring (32) to hold the driven pad (33) inside. Multiple connecting holes (351) are defined respectively in/through the positioning ring (32) and the cover (35), and multiple fasteners (352) are mounted through/into the through holes (351) to securely connect the cover (35) onto the positioning ring (32).

The coil torsion spring (34) is connected to the reeling shaft and may be mounted in the top cap (12) or the bottom cap (13). The coil torsion spring (34) has an inner end and an outer end. When the coil torsion spring (34) is mounted in the top cap (12), the coil torsion spring (34) is mounted on the top of the driven pad (33) and held in the cover (35), and is mounted around and connected to the central shaft (311) of the ratchet (31). The inner end of the coil torsion spring (34) is connected to the central shaft (311) of the ratchet (31), and the outer end is connected to the cover (35). When the coil torsion spring (34) is mounted in the bottom cap (13), the inner end of the spring (34) is connected to the reeling shaft (14) and the outer end is connected to the bottom cap (13).

With reference to FIGS. 2, 8 and 12 to 15, the delaying assembly (40) is mounted in the top cap (12), is connected to the ratchet assembly (30) and comprises a base (41), a gear assembly (42), a delaying element (43,432) and a lid (44). The base (41) is rotatably mounted in the top cap (12) and is connected to the driven pad (33) to drive the driven pad (33) to rotate. The base (41) has a top, a bottom and a driving rod (411). The driving rod (411) is formed on and protrudes from the bottom of the base (41) and is inserted into the driven hub (333) on the driven pad (33).

The gear assembly (42) is mounted in the base (41) and comprises multiple gears engaging each other and including a connecting gear (421) and an exposed gear (422) engaging the curved rack (122) in the top cap (12).

The delaying element (43,432) is mounted rotatably in the base (41) and has a pinion engaging the connecting gear (421) of the gear assembly (42). In the first embodiment shown in FIGS. 12 and 13, the delaying element (43) has multiple fins (431) formed on the top of the delaying element (43). With the fins (431) on the delaying element (43), the rotation speed of the delaying element (43) and the gear assembly (42) can be reduced with the increased air drag force due to the fins (431). In a second embodiment shown in FIG. 14, the delaying element (432) is a weight in a flywheel type. The weight can also efficiently reduce the rotating speed of the gear assembly (42).

The lid (44) is attached securely to the top of the base (41), covers the gear assembly (42) and the delaying element (43, 432) and has a top, a gear hole (441), a resilient tab (443) and a pushed frame (442). The gear hole (441) is defined through the top of the lid (44) to allow the exposed gear (422) of the gear assembly (42) extending out and being exposed from the gear hole (441) to engage the curved rack (122) in the top cap (12). The resilient tab (443) is formed on the top of the lid (44) adjacent to the gear hole (441) and engages the exposed gear (422). The pushed frame (442) is formed on the top of the lid (44), may be adjacent to the gear hole (441) and holds around the exposed gear (422).

With reference to FIGS. 2, 12 and 15 to 17, the driving device (50) is mounted on the top cap (12), is connected to the delaying assembly (30) and comprises a rotating plate (51), a torsion spring (53) and a pushing tab (52). The rotating plate (51) is mounted rotatably in the top cap (12), is connected to the delaying assembly (40) and has a pushing protrusion (511) formed on the rotating plate (51) and abutting with the pushed frame (442) on the lid (44). The torsion spring (53) is mounted in the top cap (12) and has two ends connected respectively to the top cap (12) and the rotating plate (51) to provide a recoil force to the rotating plate (51). The pushing tab (52) is connected securely to the rotating plate (51) and is mounted slidably through and extends out from the slot (123) in the top cap (12). The pushing tab (52) has a top, an engaging block (521) and a pressing knob (522). The engaging block (521) is formed on the pushing tab (52) and engages the engaging notch (124) in of the slot (123) to keep the pushing tab (52) from being slit along the slot (123). The pressing knob (522) is formed on the top of the pushing tab (52). When a user presses the pressing knob (522) downward, the engaging block (521) will disengage from the engaging notch (124) to make the pushing tab (52) slidable along the slot (123).

Figure 20:
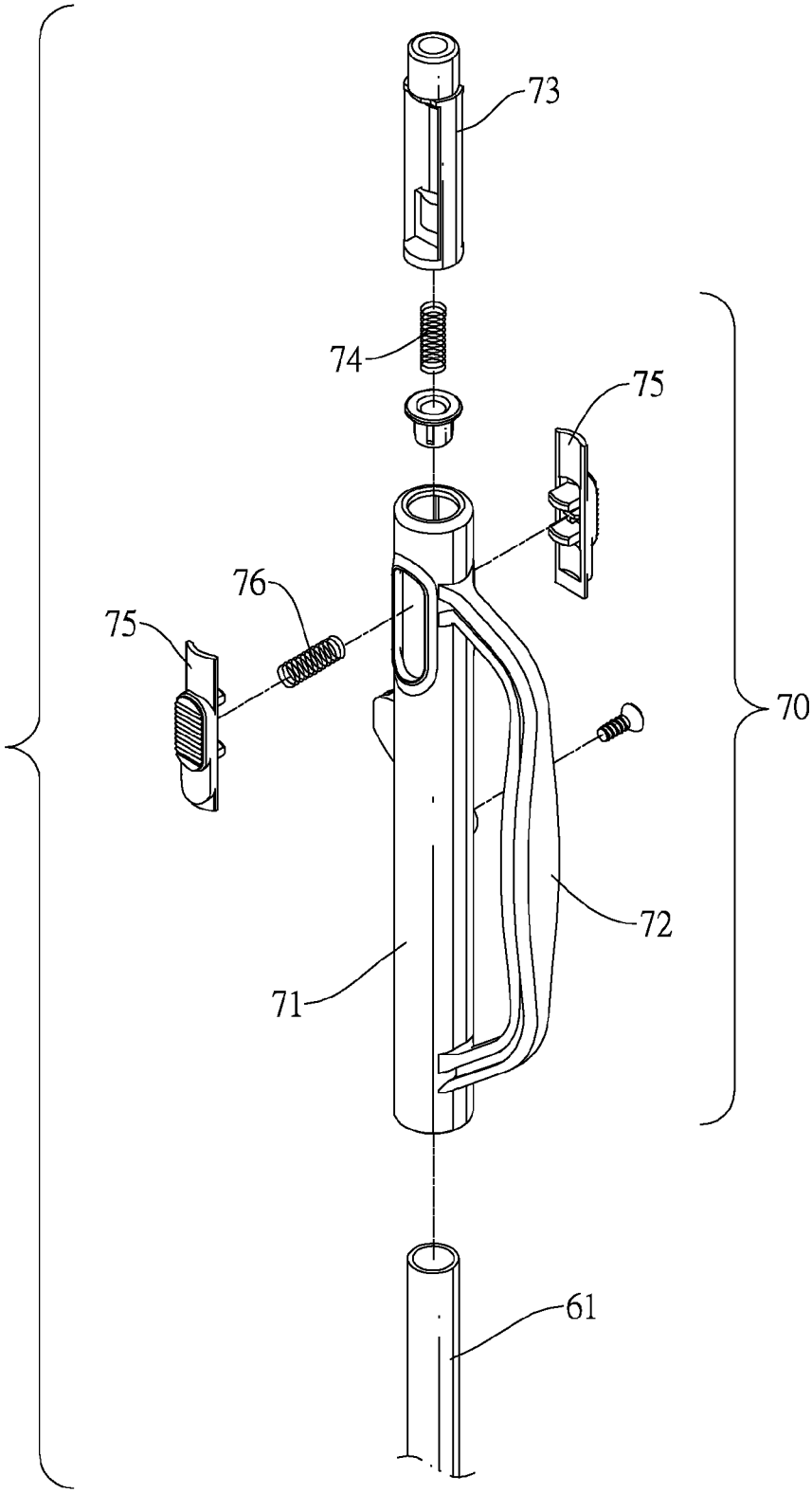
FIG. 20 is an exploded perspective view of the positioning device with the connecting rod of the fabric gate in FIG. 1.
Figure 21:
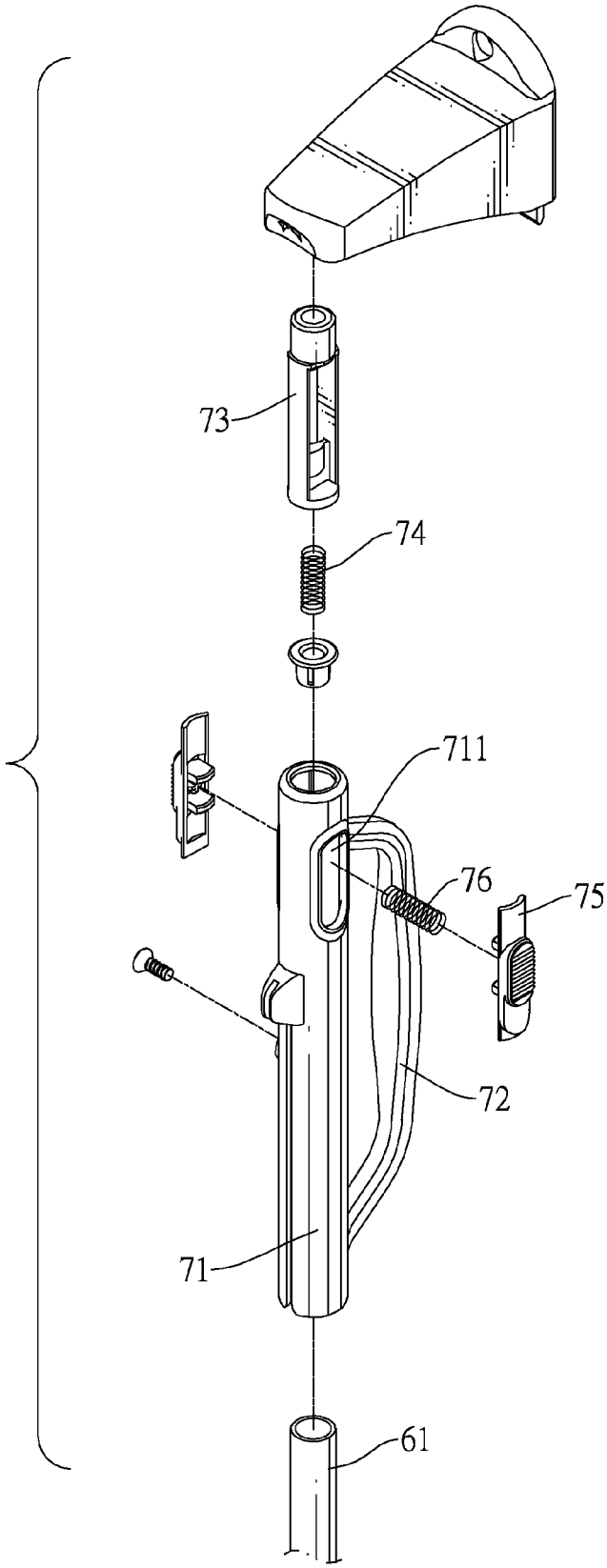
FIG. 21 is another exploded perspective view of the positioning device with the connecting rod of the fabric gate in FIG. 1.

With reference to FIGS. 2, 20 and 21, the expandable fabric (60) is reeled around the reeling shaft (14) and has an expanded end extending out from the fabric outlet (111) in the post (11) and provided with a connecting rod (61). The connecting rod (61) has a top and a positioning device (70) mounted on the top of the connecting rod (61). The positioning device (70) comprises a tubular body (71), a handle (72), a positioning rod (73), a rod spring (74), two pressing buttons (75) and a button spring (76). The tubular body (71) is mounted around the top of the connecting rod (61) and has a top and a window (711) formed laterally through the tubular body (71). The handle (72) is formed on and protrudes from the tubular body (71) to allow a user to pull and expand the fabric (60) with gripping the handle (72). The positioning rod (73) is mounted retractably on the top of the tubular body (71). The rod spring (74) is mounted in the tubular body (71) and abuts with the positioning rod (73) to provide a force to push the positioning rod (73) outward relative to the top of the tubular body (71). The pressing buttons (75) are mounted slidably in the window (711) of the tubular body (71) and each has at least one holding tab selectively engaging the positioning rod (73). The button spring (76) is mounted in the tubular body (71) between the pressing buttons (75) to provide a force to the pressing buttons (75) disengaging from the positioning rod (73).

The connecting column assembly (80) is parallel with the reeling column assembly (10) and comprises a connecting board (81) and two rod mounts (83). The connecting board (81) is attached securely to a wall with fasteners and has a top and a bottom. The rod mounts (83) are mounted respectively on the top and the bottom of the connecting board (81) to hold the connecting rod (61) on the expandable fabric (60) between the rod mounts (83) at an expended condition. The rod mount (83) on the top of the connecting board (81) selectively engages the positioning rod (73) of the positioning device (70) on the top of the connecting rod (61) and has an inclined guiding surface (831) formed in the rod mount (83).

Figure 10:
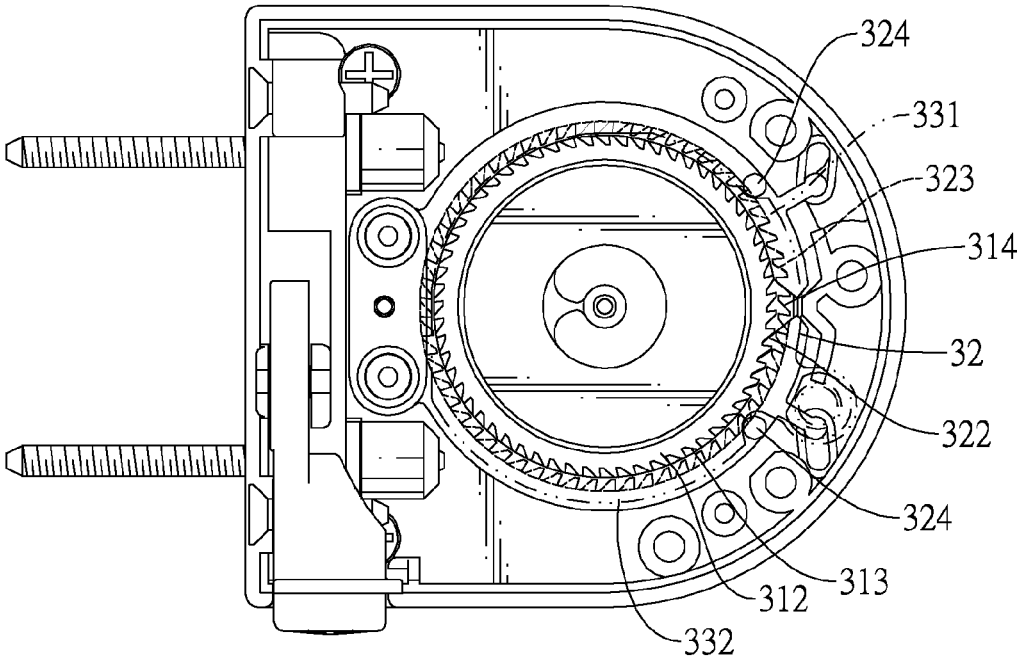
FIG. 10 is a top view of the ratchet assembly with the top cap of the fabric gate in FIG. 1.
Figure 11:
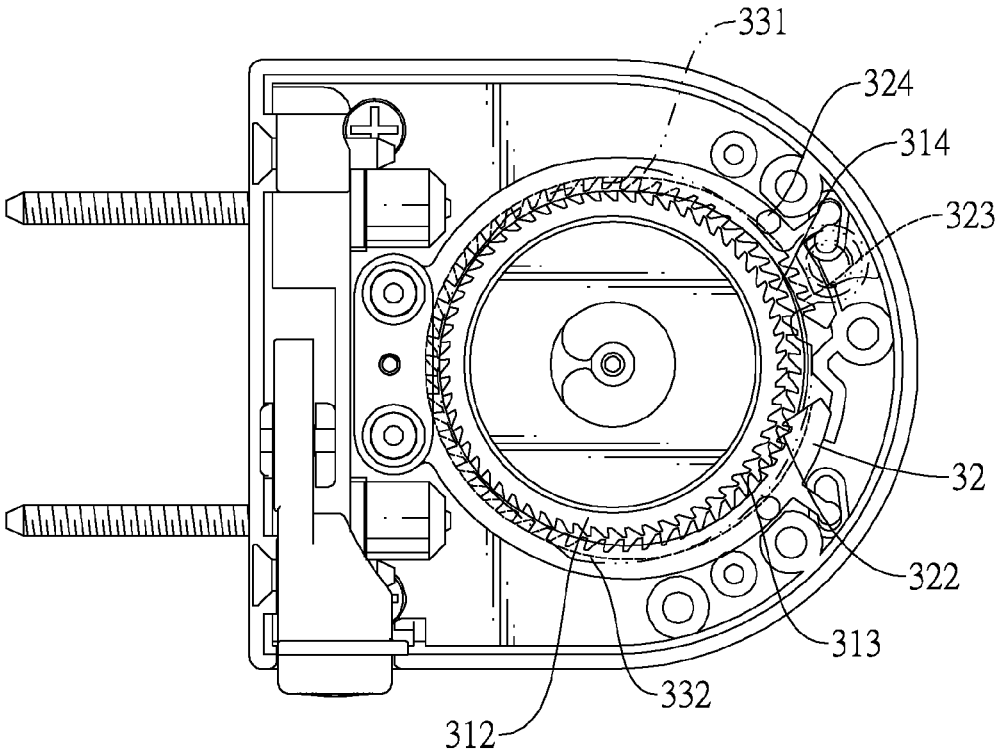
FIG. 11 is an operational top view of the ratchet assembly with the top cap of the fabric gate in FIG. 1.
Figure 12:
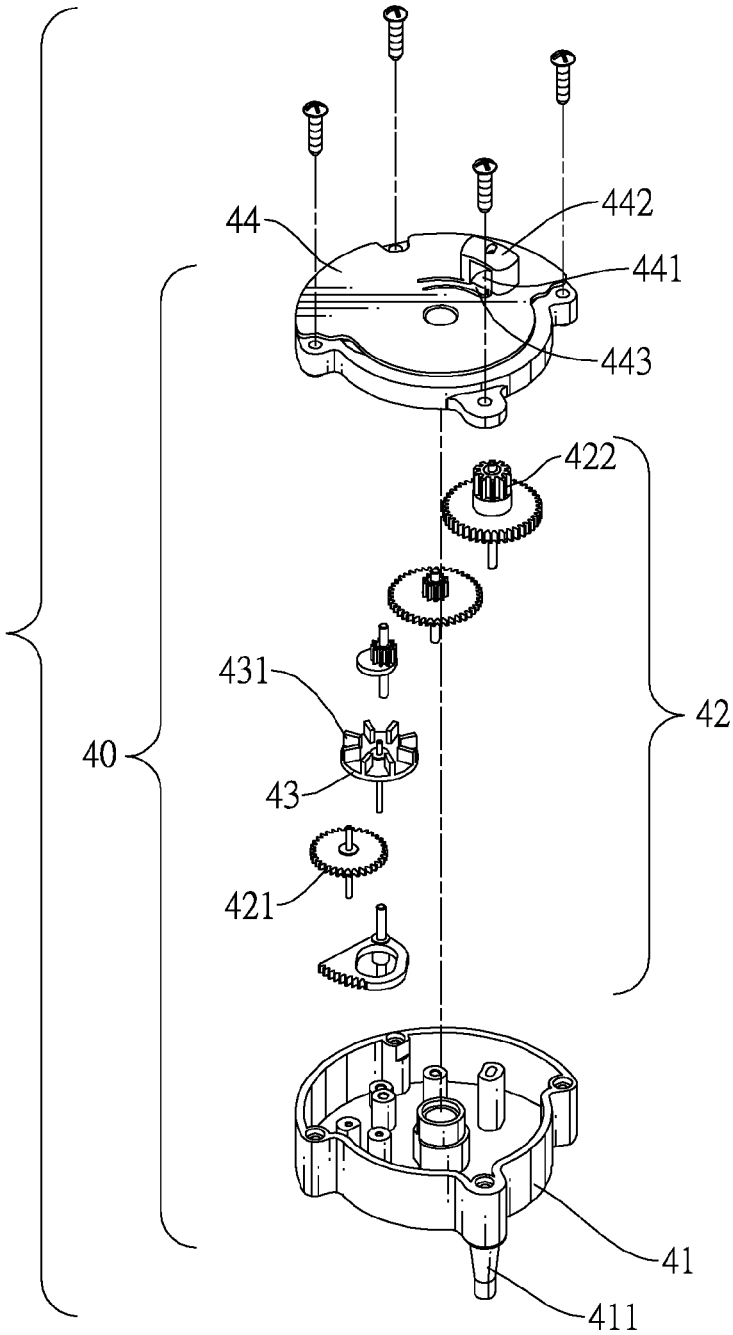
FIG. 12 is an exploded perspective view of the delaying assembly of the fabric gate in FIG. 1.
Figure 13:
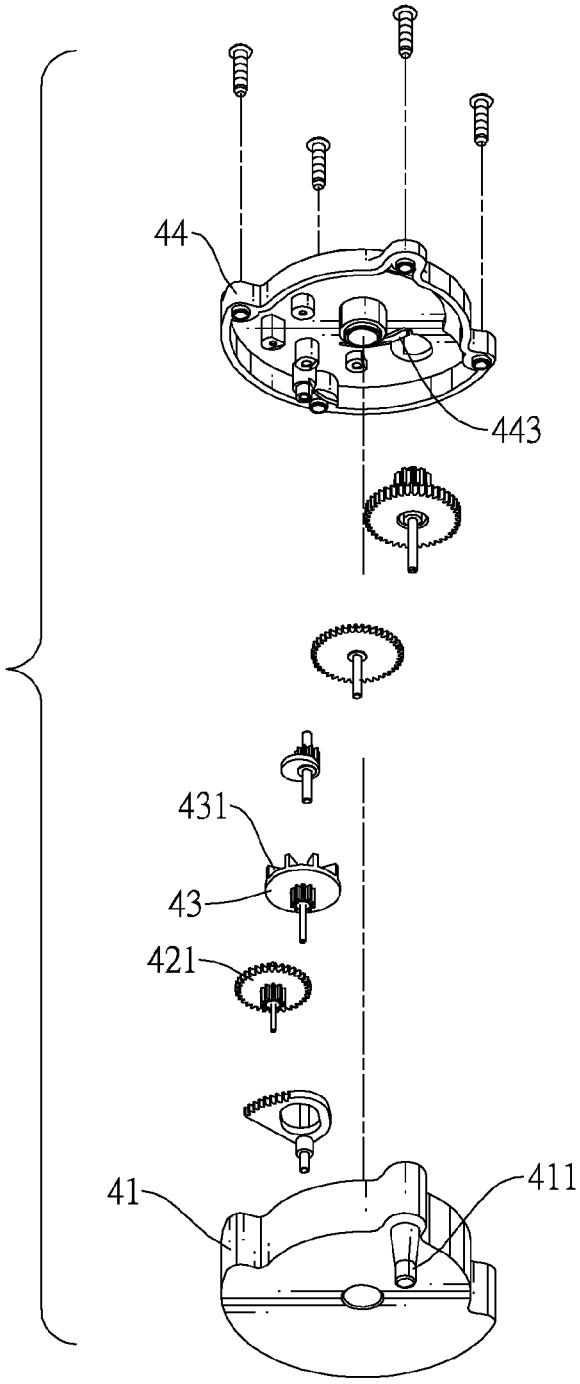
FIG. 13 is another exploded perspective view of the delaying assembly of the fabric gate in FIG. 1.
Figure 14:
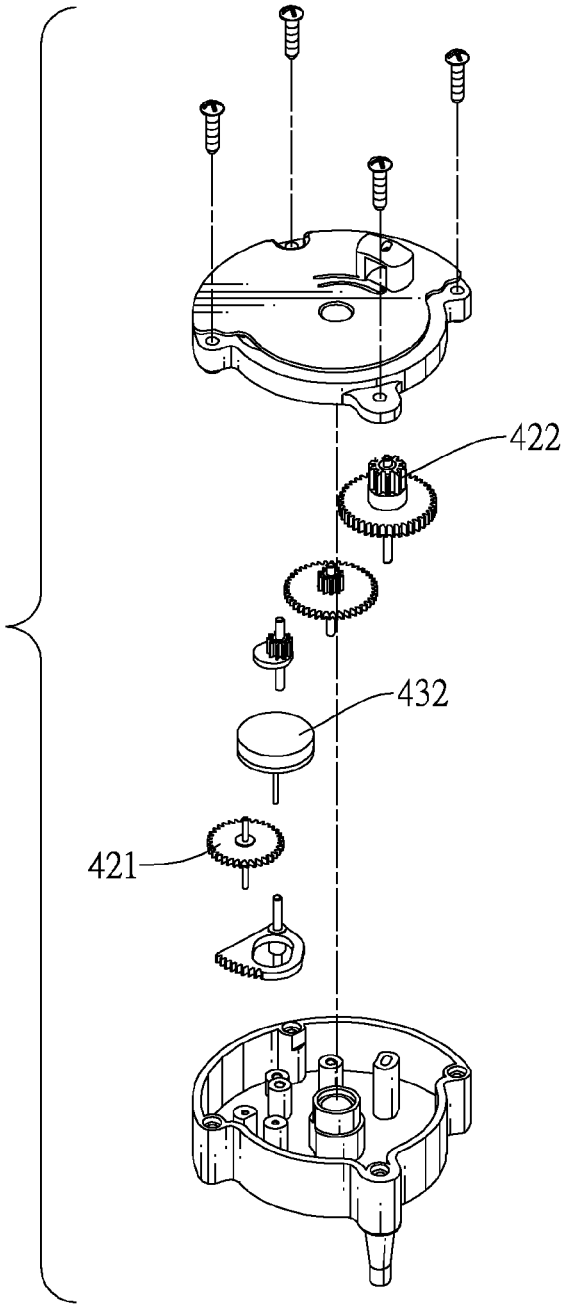
FIG. 14 is an exploded perspective view of another embodiment of a delaying assembly in accordance with the present invention.

When the fabric is at a reeled condition, with reference to FIGS. 2, 9 and 10, the upper engaging tooth (322) and the lower engaging tooth (323) on the positioning ring (32) engage simultaneously the upper ratchet teeth (313) and the lower ratchet teeth (314) on the ratchet (33). Because the ratchet teeth (313,314) extend toward opposite directions, the ratchet and the reeling shaft are kept from rotation in both of the opposite directions.

To expand the fabric, with reference to FIGS. 2, 8, 11, 12, 15, 16, 18, 19 and 20, the pressing knob (522) is pressed to disengage the engaging block (521) from the engaging notch (124) and make pushing tab (52) slidable along the slot (123).

With pushing the pushing tab (52) along the slot (123), the lid (44) with the base (41) will be rotated relative to the top cap (12) with the pushing protrusion (511) pushing against the pushed frame (442) on the lid (44). With the rotation of the base (41), the driven pad (33) is rotated to make the curved extensions (331,332) pushing respectively against the stubs (324) on the positioning ring (32) to expend the positioning ring (32). Consequently, the engaging teeth (322,323) are disengaged from the ratchet teeth (313,314) on the ratchet (33), such that the ratchet (33) and the reeling shaft (14) are rotatable. Thus, the user can pull and the expend the fabric (60) out of the fabric outlet (111) in the post (11) and connect the connecting rod (61) between the rod mounts (83) at position. With the arrangement of the inclined guiding surface (831) on the rod mount (83), the positioning rod (73) will be retracted into the tubular body (71) automatically and be pushed outward to engage the corresponding rod mount (83) with the force provided by the rod spring (74). With the expanded fabric (60), a safety zone can be formed in a room to prevent children or pets entering into a dangerous zone.

When the pushing tab (52) is released, the pushing tab (52), the rotating plate (51), the base (41) and the driven pad (33) will move/rotate to the original positions with the recoil force of the spring (53). At this time, with the arrangement of the delaying element (43,432) of the delaying assembly (40), the rotation speed of the gear assembly (42) and the base (41) will be slowed down. Therefore, the user has an enough time for completely expanding the fabric (60) even when the user releases the pushing tab (52) immediately after the pushing tab (52) being slit. With the reverse rotation of the driven pad (33), the positioning ring (32) will be released and the engaging teeth (322,323) on the positioning ring (32) will reengage the ratchet teeth (313,314) on the ratchet (33). Accordingly, the ratchet (33) and the reeling shaft (14) are kept from rotating and the fabric (60) will be retracted unintentionally.

If someone wants to pass the passage blocked by the expended fabric (60), the pressing buttons (75) are pressed to engage the holding tabs with the positioning rod (73) and then are moved downward along the window (711) to make the positioning rod (73) moving downward and disengaging from the corresponding rod mount (83). The pressing knob (522) is pressed and pushing tab (52) is slit along the slot (123) to expand the positioning ring (32) with the transmission of the rotating plate (51), the lid (44), the base (41) and the driven pad (33). Consequently, the fabric will be retracted and reeled automatically with the recoil force of the coil torsion spring (34). With the speed-reducing effect provided by the delaying element (43,432) of the delaying assembly (40), the reeling shaft (14) and the ratchet (31) will not be locked immediately by the positioning ring (32) after the user releasing the pushing tab (52). Therefore, the user has an enough time to reel the fabric (60) at a desired length to allow the user to pass and re-expand the fabric (60) to the expended coition again.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fabric gate comprising:

a reeling column assembly comprising
- a hollow post having a central hole defined through the post and a fabric outlet defined longitudinally in the post and communicating with the central hole;
- a top cap and a bottom cap attached respectively to two ends of the post, and the top cap having a slot defined laterally in the top cap; and
- a reeling shaft mounted rotatably in the central hole in the post and having a top end;

a ratchet assembly mounted in the top cap of the reeling column assembly and comprising
- a ratchet mounted rotatably in the top cap and having
  - a central shaft mounted securely around the top end of the reeling shaft; and
  - a wheel formed around the central shaft and having multiple upper ratchet teeth and multiple lower ratchet teeth, wherein the upper ratchet teeth extend toward a direction opposite to that of the lower ratchet teeth extending;
- a positioning ring mounted around the wheel of the ratchet and having
  - a top;
  - an inner surface;
  - a notch defined in the positioning ring to make the positioning ring having an expandable capability and two ends;
  - an upper engaging tooth and a lower engaging tooth formed on the inner surface of and respectively at the ends of the positioning ring and engaging respectively with the upper ratchet teeth and the lower ratchet teeth on the ratchet; and
  - two stubs formed on and protruding from the top respectively near the ends of the positioning ring;
- a driven pad attached to the top of the positioning ring, mounted around the central shaft of the ratchet and having
  - a top;
  - a periphery; and
  - two curved extensions formed separately on and protruding radially from the periphery of the driven pad, wherein each curved extension has an end abutting with one of the stubs on the positioning ring;

a coil torsion spring connected to the reeling shaft;

a delaying assembly mounted in the top cap and connected to the ratchet assembly;

a driving device mounted in the top cap, connected to the delaying assembly and comprising
- a rotating plate mounted rotatably in the top cap and connected to the delaying assembly;
- a torsion spring mounted in the top cap and having two ends connected respectively to the top cap and the rotating plate to provide a recoil force to the rotating plate; and
- a pushing tab connected securely to the rotating plate and mounted slidably through and extending out from the slot in the top cap;

an expandable fabric reeled around the reeling shaft and having an expanded end extending out from the fabric outlet in the post; and a connecting column assembly being parallel with the reeling column assembly and holding the expanded end of the expandable fabric in position.

2. The fabric gate as claimed in claim 1, wherein
the expandable fabric further has a connecting rod mounted on the expanded end of the expandable fabric;
the connecting column assembly comprises
a connecting board having a top and a bottom; and
two rod mounts mounted respectively on the top and the bottom of the connecting board to hold the connecting rod on the expandable fabric between the rod mounts; and
the connecting rod has a top and a positioning device mounted on the top of the connecting rod and comprising
a tubular body mounted around the top of the connecting rod and having a top and a window formed laterally through the tubular body;
a handle formed on and protruding from the tubular body;
a positioning rod mounted retractably on the top of the tubular body and selectively engaging the rod mount that is mounted on the top of the connecting board;
a rod spring mounted in the tubular body and abutting with the positioning rod;
two pressing buttons mounted slidably in the window of the tubular body and each has at least one holding tab selectively engaging the positioning rod; and
a button spring mounted in the tubular body between the pressing buttons.

3. The fabric gate as claimed in claim 1, wherein the reeling column assembly further comprises a locking assembly attached to the post, connected to the top cap and the bottom cap and having
a securing board attached to the post and having two ends; and
two locking devices connected respectively to the ends of the securing board, are connected respectively to the top and bottom caps, each having
a locking board securely connected to a corresponding one end of the securing board and having
a board edge connected to the corresponding end of the securing board;
a connecting edge being opposite to the board edge;
multiple inserts formed on and protruding from the board edge of the locking board and inserted respectively into the corresponding end of the securing board;
multiple inserting holes defined in the connecting edge of the locking board; and
multiple fasteners mounted through the securing locking board; and
a connecting bracket connected to the connecting edge of the locking board, connected securely to one of the top and bottom caps and having
two edges;
a cap side faces to a corresponding one of the top and bottom caps;
a connecting side being opposite to the cap side;
multiple cap hooks formed on the cap side at one edge of the connecting bracket and engaging the corresponding cap;
multiple board hooks formed on the connecting side at the other edge of the connecting bracket and inserted respectively into the inserting holes in the locking board; and
multiple fasteners mounted through the connecting bracket, inserted into the corresponding cap and aligned respectively with the fasteners on the locking board in an axial direction.

4. The fabric gate as claimed in claim 3, wherein
the locking device that is connected to the top cap further has a protrusion formed on and protruding from the connecting edge of the locking board; and
the top cap further has a locker mounted in the top cap and having a resilient hook engaging the protrusion on the locking board of a corresponding one of the locking devices.

5. The fabric gate as claimed in claim 1, wherein
the delaying assembly comprises:
a base connected to the driven pad to drive the driven pad to rotate;
a gear assembly mounted in the base and comprising multiple gears engaging each other and including a connecting gear and an exposed gear;
a delaying element mounted rotatably in the base and having a pinion engaging the connecting gear of the gear assembly; and
a lid attached securely to the top of the base, covering the gear assembly and the delaying element and having
a top;
a gear hole defined through the top of the lid to allow the exposed gear of the gear assembly extending out and exposed from the gear hole; and
a pushed frame formed on the top of the lid;
the top cap further has a curved rack formed in the top cap and engaging the exposed gear; and
the rotating plate further has a pushing protrusion formed on the rotating plate and abutting with the pushed frame on the lid of the delaying assembly.

6. The fabric gate as claimed in claim 5, wherein the lid of the delaying assembly further has a resilient tab formed on the top of the lid adjacent to the gear hole and engaging the exposed gear.

7. The fabric gate as claimed in claim 6, wherein the delaying element of the delaying assembly has multiple fins formed on the top of the delaying element.

8. The fabric gate as claimed in claim 7, wherein the reeling column assembly further comprises a locking assembly attached to the post, connected to the top cap and the bottom cap and having
a securing board attached to the post and having two ends; and
two locking devices connected respectively to the ends of the securing board, are connected respectively to the top and bottom caps, each having
a locking board securely connected to a corresponding one end of the securing board and having
a board edge connected to the corresponding end of the securing board;
a connecting edge being opposite to the board edge;
multiple inserts formed on and protruding from the board edge of the locking board and inserted respectively into the corresponding end of the securing board;
multiple inserting holes defined in the connecting edge of the locking board; and
multiple fasteners mounted through the securing locking board; and
a connecting bracket connected to the connecting edge of the locking board, connected securely to one of the top and bottom caps and having
two edges;
a cap side faces to a corresponding one of the top and bottom caps;
a connecting side being opposite to the cap side;

multiple cap hooks formed on the cap side at one edge of the connecting bracket and engaging the corresponding cap;

multiple board hooks formed on the connecting side at the other edge of the connecting bracket and inserted respectively into the inserting holes in the locking board; and multiple fasteners mounted through the connecting bracket, inserted into the corresponding cap and aligned respectively with the fasteners on the locking board in an axial direction.

9. The fabric gate as claimed in claim 8, wherein the locking device that is connected to the top cap further has a protrusion formed on and protruding from the connecting edge of the locking board; and the top cap further has a locker mounted in the top cap and having a resilient hook engaging the protrusion on the locking board of a corresponding one of the locking devices.

10. The fabric gate as claimed in claim 9, wherein the slot of the top cap has an engaging notch defined in an edge of the slot; and the pushing tab further has an engaging block formed on the pushing tab and engaging the engaging notch in of the slot to keep the pushing tab from being slit along the slot.

11. The fabric gate as claimed in claim 10, wherein the expandable fabric further has a connecting rod mounted on the expanded end of the expandable fabric; and the connecting column assembly comprises a connecting board having a top and a bottom; and two rod mounts mounted respectively on the top and the bottom of the connecting board to hold the connecting rod on the expandable fabric between the rod mounts.

12. The fabric gate as claimed in claim 11, wherein the connecting rod has a top and a positioning device mounted on the top of the connecting rod and comprising a tubular body mounted around the top of the connecting rod and having a top and a window formed laterally through the tubular body;

a handle formed on and protruding from the tubular body;

a positioning rod mounted retractably on the top of the tubular body and selectively engaging the rod mount that is mounted on the top of the connecting board;

a rod spring mounted in the tubular body and abutting with the positioning rod;

two pressing buttons mounted slidably in the window of the tubular body and each has at least one holding tab selectively engaging the positioning rod; and a button spring mounted in the tubular body between the pressing buttons.

13. The fabric gate as claimed in claim 12, wherein the coil torsion spring is mounted in the top cap and on the top of the driven pad, is mounted around and connected to the central shaft of the ratchet and has an inner end connected to the central shaft of the ratchet and an outer end the ratchet assembly further has a cover mounted securely in the top cap, attached securely to the top of the positioning ring to hold the driven pad and the coil torsion spring inside and connected securely to the outer end of the coil torsion spring;

the driven pad of the ratchet assembly further has a driven hub formed on and protrudes radially from the periphery of the driven pad and between the curved extensions; and the base of the delaying assembly has a bottom and a driving rod formed on and protruding from the bottom of the base and inserted into the driven hub on the driven pad.

14. The fabric gate as claimed in claim 6, wherein the delaying element of the delaying assembly is a weight in a flywheel type.

15. The fabric gate as claimed in claim 14, wherein the reeling column assembly further comprises a locking assembly attached to the post, connected to the top cap and the bottom cap and having a securing board attached to the post and having two ends; and two locking devices connected respectively to the ends of the securing board, are connected respectively to the top and bottom caps, each having a locking board securely connected to a corresponding one end of the securing board and having a board edge connected to the corresponding end of the securing board;

a connecting edge being opposite to the board edge;

multiple inserts formed on and protruding from the board edge of the locking board and inserted respectively into the corresponding end of the securing board;

multiple inserting holes defined in the connecting edge of the locking board; and multiple fasteners mounted through the securing locking board; and a connecting bracket connected to the connecting edge of the locking board, connected securely to one of the top and bottom caps and having two edges;

a cap side faces to a corresponding one of the top and bottom caps;

a connecting side being opposite to the cap side;

multiple cap hooks formed on the cap side at one edge of the connecting bracket and engaging the corresponding cap;

multiple board hooks formed on the connecting side at the other edge of the connecting bracket and inserted respectively into the inserting holes in the locking board; and multiple fasteners mounted through the connecting bracket, inserted into the corresponding cap and aligned respectively with the fasteners on the locking board in an axial direction.

16. The fabric gate as claimed in claim 15, wherein the locking device that is connected to the top cap further has a protrusion formed on and protruding from the connecting edge of the locking board; and the top cap further has a locker mounted in the top cap and having a resilient hook engaging the protrusion on the locking board of a corresponding one of the locking devices.

17. The fabric gate as claimed in claim 16, wherein the slot of the top cap has an engaging notch defined in an edge of the slot; and the pushing tab further has an engaging block formed on the pushing tab and engaging the engaging notch in of the slot to keep the pushing tab from being slit along the slot.

18. The fabric gate as claimed in claim 17, wherein the expandable fabric further has a connecting rod mounted on the expanded end of the expandable fabric; and the connecting column assembly comprises a connecting board having a top and a bottom; and two rod mounts mounted respectively on the top and the bottom of the connecting board to hold the connecting rod on the expandable fabric between the rod mounts.

19. The fabric gate as claimed in claim 18, wherein the connecting rod has a top and a positioning device mounted on the top of the connecting rod and comprising a tubular body mounted around the top of the connecting rod and having a top and a window formed laterally through the tubular body;

a handle formed on and protruding from the tubular body;

a positioning rod mounted retractably on the top of the tubular body and selectively engaging the rod mount that is mounted on the top of the connecting board;

a rod spring mounted in the tubular body and abutting with the positioning rod;

two pressing buttons mounted slidably in the window of the tubular body and each has at least one holding tab selectively engaging the positioning rod; and a button spring mounted in the tubular body between the pressing buttons.

20. The fabric gate as claimed in claim 19, wherein the coil torsion spring is mounted in the top cap and on the top of the driven pad, is mounted around and connected to the central shaft of the ratchet and has an inner end connected to the central shaft of the ratchet and an outer end the ratchet assembly further has a cover mounted securely in the top cap, attached securely to the top of the positioning ring to hold the driven pad and the coil torsion spring inside and connected securely to the outer end of the coil torsion spring;

the driven pad of the ratchet assembly further has a driven hub formed on and protrudes radially from the periphery of the driven pad and between the curved extensions; and the base of the delaying assembly has a bottom and a driving rod formed on and protruding from the bottom of the base and inserted into the driven hub on the driven pad.

* * * * *